United States Patent [19]

Jungbluth

[11] 4,271,654

[45] Jun. 9, 1981

[54] THREE-DIMENSIONAL STRUCTURES OF FRAME BEAMS AND MULTIPLE JOINTS

[76] Inventor: Otto Jungbluth, Frankensteiner Strasse 99, 6100 Darmstadt-Eberstadt, Fed. Rep. of Germany

[21] Appl. No.: 874,871

[22] Filed: Feb. 3, 1978

[30] Foreign Application Priority Data

Feb. 7, 1977 [DE] Fed. Rep. of Germany ..... 2704954

[51] Int. Cl.[3] ..... F16B 7/18

[52] U.S. Cl. ..... 52/637; 52/648; 403/172

[58] Field of Search ..... 52/638, 637, 648; 403/172, 171, 7, 8; 85/9 R, 50 R, 45, 36, 1 L

[56] References Cited

U.S. PATENT DOCUMENTS 4,082,470 4/1978 Alberts ..... 403/7

FOREIGN PATENT DOCUMENTS 80653 3/1956 Denmark ..... 85/45

1130897 10/1956 France ..... 403/171

*Primary Examiner*—Reinaldo P. Machado

*Attorney, Agent, or Firm*—Frishauf, Holtz, Goodman and Woodward

[57] ABSTRACT

Three-dimensional structures are made of open or closed profile structural beams, said beams being connected perpendicularly to each other at all multiple joints and joined by an end face plate of said beams with cubic multiple joints. Such three-dimensional structures possess extremely good bearing property, said bearing capacity amounting to two and a half times its elastic limit so that these structures can compete economically with three-dimensional truss structures.

4 Claims, 17 Drawing Figures

Fig. 3A
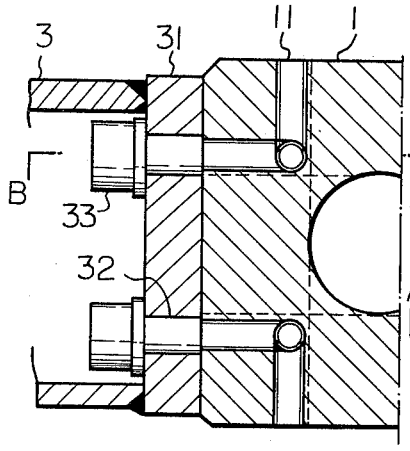
Fig. 3B
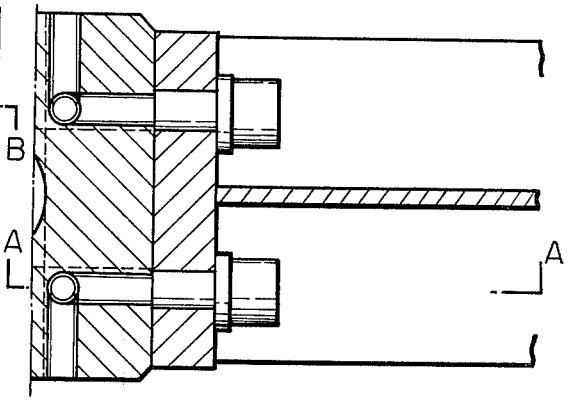
Fig. 4
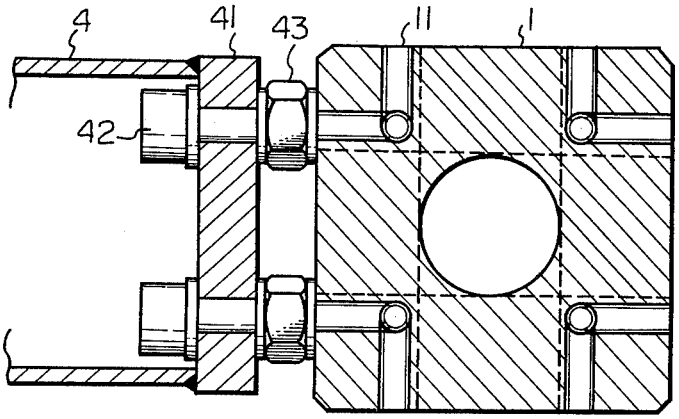
Fig. 5A
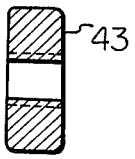
Fig. 5B
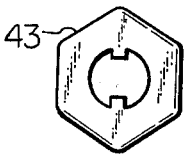
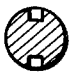
Fig. 6A
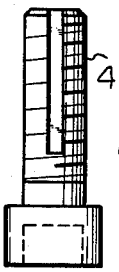
Fig. 6B

THREE-DIMENSIONAL STRUCTURES OF FRAME BEAMS AND MULTIPLE JOINTS

BACKGROUND OF THE INVENTION

This invention relates to three-dimensional structures made of open or closed profile structural beams, said beams being connected perpendicularly to each other at all multiple joints and joined by the face plate of said beams with cubic multiple joints.

Various three-dimensional structures known as truss constructions can only transfer normal forces due to the truss constructional system and therefore their beam connections can take up only tensile and compressive stresses. Some of these trusses possess their own multiple joints such as spherical or bent sheet joints.

SUMMARY OF THE INVENTION

An object of this invention is to reduce the number of diagonal beams in a three-dimensional frame structure, to place beams only perpendicularly to each other and to connect them with resistance to bending, transverse force and torsion in a simple manner to provide a construction system by which structures can be easily prefabricated and dismantled.

It is generally expected to create a special architectural effect with three-dimensional structures. That is why the design technology is of special importance for connecting beams, which should be resistant to bending, transverse force and torsion, so that the connecting means remains almost or nearly invisible.

Other objects and advantages of this invention will become apparent to those skilled in the art from the following description and drawings.

BRIEF DESCRIPTION OF THE DRAWINGS

FIG. 3A shows a sectional view looking along the line A—A of FIG. 3B in a connection of a face plate of an open profile of I-shaped cross-section with a closed cubic multiple joint.

FIG. 3B shows a sectional view looking along the line B—B of FIG. 3A.

FIG. 4 shows a sectional view of a face plate of a square hollow profile connected with a tightening disc with a closed cubic multiple joint.

FIG. 5A shows a sectional view of a tightening disc.

FIG. 5B shows a plan view of a tightening disc.

FIG. 6A shows a cross-sectional view of a slotted screw.

FIG. 6B shows a slotted screw.

DESCRIPTION OF THE PREFERRED EMBODIMENTS

According to the invention, the object is achieved by providing the beams with face plates which do not protrude, or which protrude insignificantly, for taking up the weld seam over the rectangularly defined cross-sectional surface of the beams and by use of a cubic multiple joint with nearly the same dimensions as that of the rectangularly defined corss-sectional surface of the beams. A further feature of the invention is that the face plate connections are made by means of at least two and preferably four high strength steel bolts which are arranged inside of the rectangularly defined cross-sectional surface of the beams.

With respect to the constructional design of the frame beams and multiple joints, the following four combinations are possible in accordance with the invention, namely open profiles with open multiple joints; open profiles with closed multiple joints; closed profiles with closed multiple joints and closed profiles with open multiple joints.

The closed multiple joints are provided on all six sides of the cube with at least two but preferably four threaded holes. Hollow spaces extending to the opposed surfaces may be provided between the threaded holes to reduce the weight. The closed profiled beams, which are made in rectangular (including square) shape, are connected by placing the bolts, which are put into the holes of the face plates provided with two longitudinal grooves facing each other, into threaded holes in the cubic multiple joints. The cams of the holed tightening discs take hold of the grooves of the bolts.

The open multiple joint possesses drilled holes, usually unthreaded, on five sides of the cube because the use of open profiled beams allows to screw the nut from the interior of the profile with the inserted bolts. In the case of closed profile frame beams, bolts are inserted oppositely from the inside through the holes of the open multiple joint and are screwed into the threaded holes of the bare face plates. For reinforcement, the sixth open face of the cube may have a sausage-like edge-reinforcement.

The closed and open cubic multiple joints may be made of cast steel or spheroidal graphite iron. The closed ones may also be formed from semifinished materials.

Three-dimensional grating structures made according to this invention possess an extremely good bearing property due to their high resistance to static pressure in combination with the resistance to bending, transversal force and torsion of the beam multiple joints which allow to utilize the plastic reserve completely. Tests have shown that the bearing capacity of such three-dimensional grating structures amounts to two and a half times their elastic limit so that these structures can compete economically with three-dimensional truss structures.

Figure 1A:
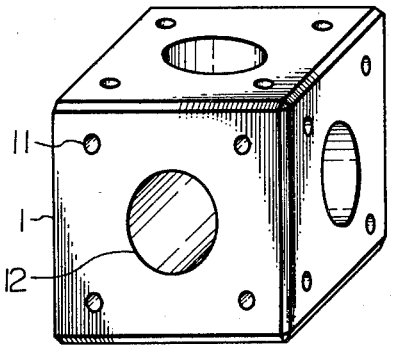
FIG. 1A shows a perspective view of a closed cubic multiple joint.
Figure 1B:
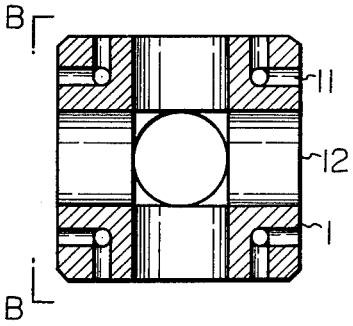
FIG. 1B shows a sectional view looking along the line A—A of FIG. 1C.
Figure 1C:
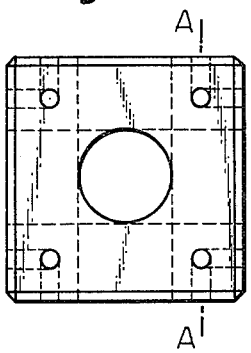
FIG. 1C shows a side view looking along the line B—B of FIG. 1B.
Figure 2B:
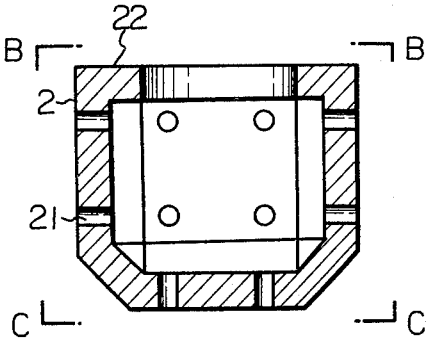
FIG. 2B shows a sectional view looking along the line A—A of FIG. 2C.
Figure 2A:
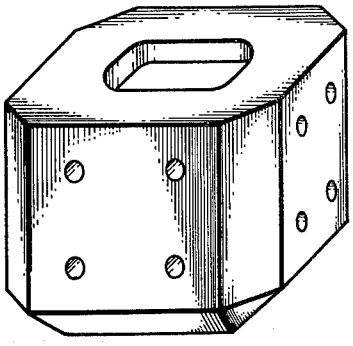
FIG. 2A shows a perspective view of an open cubic multiple joint.
Figure 2C:
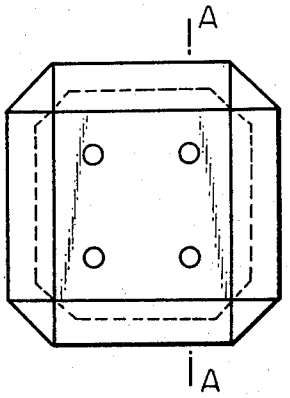
FIG. 2C shows a plan looking along the line C—C of FIG. 2B.
Figure 2D:
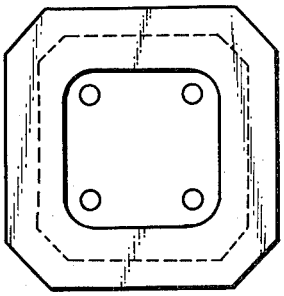
FIG. 2D shows a plan looking along the line B—B of FIG. 2B.
Figure 7:
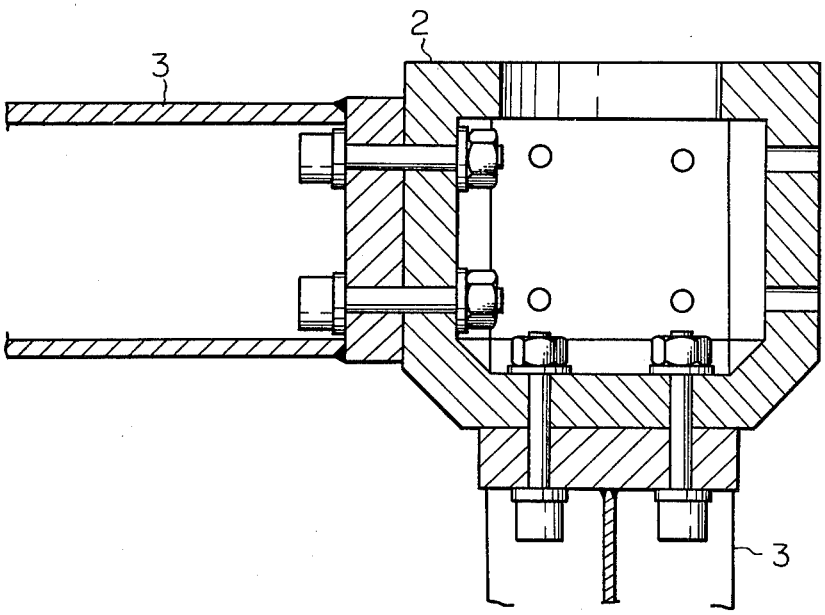
FIG. 7 shows a cross-sectional view in a connection of face plates of open profile connected with I-shaped cross-section with an open cubic multiple joint.
Figure 8:
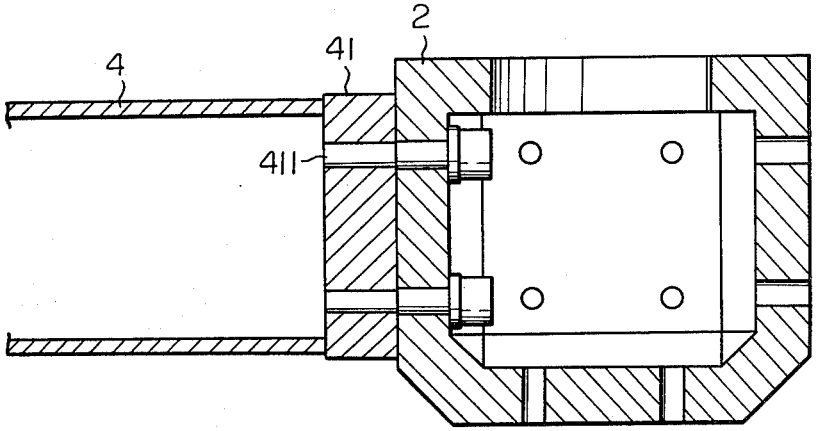
FIG. 8 shows a cross-sectional view of a square hollow profile connected with a face plate containing threaded holes with an open cubic multiple joint.
Figure 9:
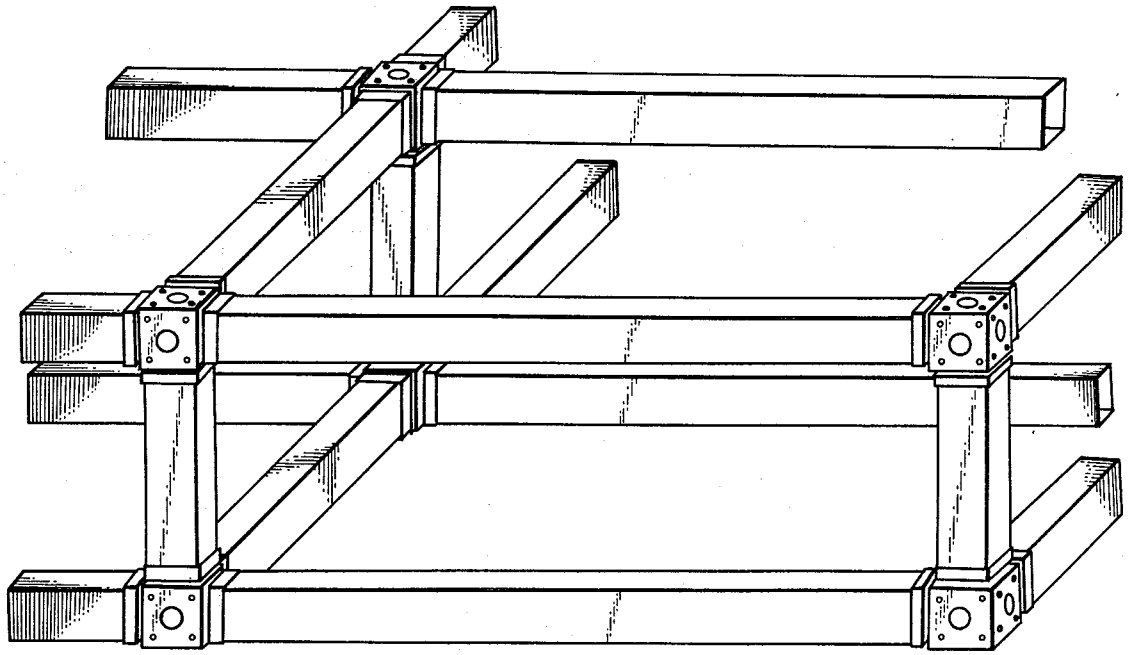
FIG. 9 shows a perspective view, as an example, of a three-dimensional grating structure made with closed profile square beams connected with the cubic multiple joints.

In FIGS. 1A, 1B, and 1C, there is illustrated a closed cubic multiple joint 1 with threaded holes 11 and hollow spaces 12. In FIGS. 2A, 2B, 2C and 2D, there is illustrated an open cubic multiple joint 2 with screwholes 21 and sausage-like edge-reinforcement 22. In FIGS. 3A and 3B, there is illustrated a connection of an open profile beam of I-shaped cross-section 3 and a face plate 31 containing the bolt-holes 32, and respective high strength steel bolts 33 with a closed cubic multiple joint 1. In FIG. 4, there is illustrated a connection of a square hollow profile beam 4 with a face plate 41, a slotted bolt 42 (see FIGS. 6A and 6B) and a tightening disc 43 (see FIGS. 5A and 5B). In FIG. 7, there is illustrated a connection of an open profile beam of I-shaped cross-section 3 with an open cubic multiple joint 2, whereas FIG. 8 shows a connection of a square tubular profile beam 4 with a face plate 41 containing threaded holes 411 and an open cubic multiple joint 2. A perspective view as shown in FIG. 9 is a schematic view of the whole system of a three-dimensional grating structure as an example with closed profiles made of square beams, which are connected at the cubic multiple joints.

What is claimed is:

1. In a three-dimentional frame beam structure made of a plurality of frame beams of open or closed metal profile steel shapes which cross perpendicularly to each other and which are interconnected at all multiple joints by means of cubic multiple joint connectors, the improvement wherein:

said frame beams each have a substantially flat face plate for connection with said cubic multiple joint connectors;

said cubic multiple joint connectors each have at least five substantially flat joining surfaces perpendicular to each other adapted to be joined with a face plate of a frame beam, said joining surfaces which are connected to a respective face plate of a beam being connected by at least two high strength bolts to its respective face plate, said at least two bolts being located within the outline of the cross-section of said frame beams; and said frame beam structure including frame beams of hollow profile shapes, and said bolts connected to said hollow profile frame beams each having two longitudinal grooves therein, and further comprising holed tightening discs having cam means engaging with said grooves for turning said grooved bolts relative to said frame beam to which said grooved bolts are connected.

2. The three-dimensional frame beam structure of claim 1 comprising at least four of said bolts connecting each of said joining surfaces to its respective face plate.

3. The three-dimensional frame beam structure of claim 1 wherein at least one of said multiple joint connectors has six closed sides, each side being provided with at least two threaded holes for threadably receiving said at least two bolts.

4. The three-dimensional frame beam structure of claim 1 wherein at least one of said multiple joint connectors has opposedly extending hollow spaces in communication with said at least two bolts.

* * * * *